US010877413B1

(12) United States Patent
Abe et al.

(10) Patent No.: US 10,877,413 B1
(45) Date of Patent: Dec. 29, 2020

(54) FIXING BELT, FIXING DEVICE, AND IMAGE FORMING APPARATUS

(71) Applicants: Hiroya Abe, Kanagawa (JP); Atsuo Hirai, Kanagawa (JP); Asae Kamata, Kanagawa (JP); Yasuhide Fujiwara, Kanagawa (JP)

(72) Inventors: Hiroya Abe, Kanagawa (JP); Atsuo Hirai, Kanagawa (JP); Asae Kamata, Kanagawa (JP); Yasuhide Fujiwara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/878,766

(22) Filed: May 20, 2020

(30) Foreign Application Priority Data

Jun. 6, 2019 (JP) ..... 2019-105821

(51) Int. Cl.
*G03G 15/20* (2006.01)

(52) U.S. Cl.
CPC ..... *G03G 15/2057* (2013.01)

(58) Field of Classification Search
CPC ..... G03G 15/2053; G03G 15/2057; G03G 15/206
See application file for complete search history.

(56) References Cited

U.S. PATENT DOCUMENTS

| | | | | |
|---|---|---|---|---|
| 2014/0241771 | A1 | 8/2014 | Endo et al. | |
| 2014/0248070 | A1 | 9/2014 | Kubo et al. | |
| 2014/0328610 | A1 | 11/2014 | Fujie et al. | |
| 2015/0277245 | A1* | 10/2015 | Kajiwara | G03G 5/14795 430/58.2 |
| 2016/0041513 | A1 | 2/2016 | Takeda et al. | |
| 2018/0314172 | A1* | 11/2018 | Sakakibara | C08L 67/00 |

FOREIGN PATENT DOCUMENTS

| | | |
|---|---|---|
| JP | 2007-114754 | 5/2007 |
| JP | 2013-122531 | 6/2013 |
| JP | 2014-170048 | 9/2014 |
| JP | 2014-178370 | 9/2014 |
| JP | 2017-223837 | 12/2017 |

* cited by examiner

*Primary Examiner* — Hoang X Ngo
(74) *Attorney, Agent, or Firm* — Oblon, McClelland, Maier & Neustadt, L.L.P.

(57) ABSTRACT

A fixing belt includes a polyimide layer. The polyimide layer includes polyimide and an aprotic solvent. The solvent has a boiling point not lower than 230° C. and a solubility parameter not less than 24.5 $(J/cm^3)^{1/2}$ and not greater than 30.7 $(J/cm^3)^{1/2}$. The solvent has a content not less than 0.1 ppm and not greater than 1000 ppm in the polyimide layer.

11 Claims, 3 Drawing Sheets

FIXING BELT, FIXING DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2019-105821, filed on Jun. 6, 2019, in the Japan Patent Office, the entire disclosure of which is hereby incorporated by reference herein.

BACKGROUND

Technical Field

The present disclosure relates to a fixing belt, a fixing device, and an image forming apparatus.

Description of the Related Art

An image forming apparatus such as a copying machine or a printer is known that includes a contact heating type fixing device in which a nip portion is formed between an endless fixing member such as a fixing belt and a pressing member such as a pressure roller, and applies heat and pressure to a recording material passing through the nip portion to fix an unfixed toner image on the recording material.

For example, an image forming apparatus includes a fixing device having a rotatable endless fixing member (e.g., a fixing belt), a nip forming member on an inner circumferential side of the fixing member, and a pressing member (e.g., a pressing roller) to press a recording material (e.g., a sheet) toward the fixing member. A lubricant is applied between the nip forming member and the fixing member (e.g., a low friction sheet) to reduce the sliding torque.

In order to maintain the image quality of the image forming apparatus, the fixing belt needs to have smoothness. If the fixing belt is undulated and has insufficient smoothness, the image quality after fixing may be degraded. In particular, in recent years, the need for high image quality has increased, and the fixing belt is also required to have high smoothness. Further, in recent years, there has been an increasing demand for high-speed image forming apparatuses as well as high image quality.

SUMMARY

In an aspect of the present disclosure, a fixing belt includes a polyimide layer. The polyimide layer includes polyimide and an aprotic solvent. The solvent has a boiling point not lower than 230° C. and a solubility parameter not less than 24.5 $(J/cm^3)^{1/2}$ and not greater than 30.7 $(J/cm^3)^{1/2}$. The solvent has a content not less than 0.1 ppm and not greater than 1000 ppm in the polyimide layer.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
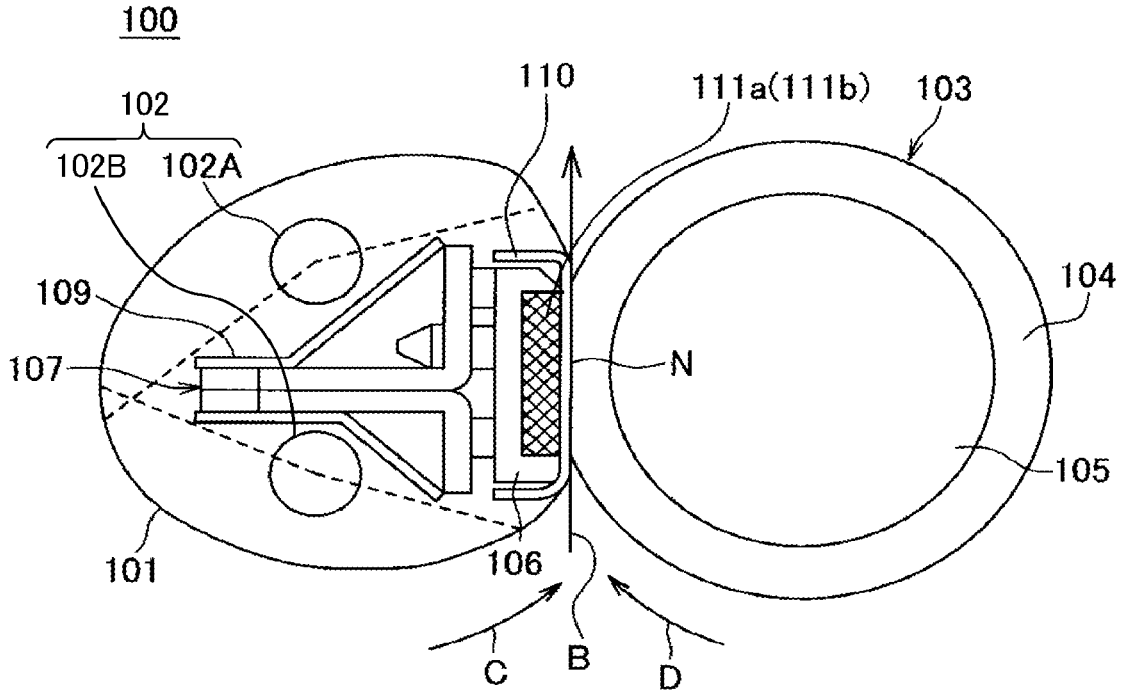
FIG. 1 is a schematic cross-sectional view of an example (a first embodiment) of a fixing device including a fixing belt according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Fixing Belt

Figure 2:
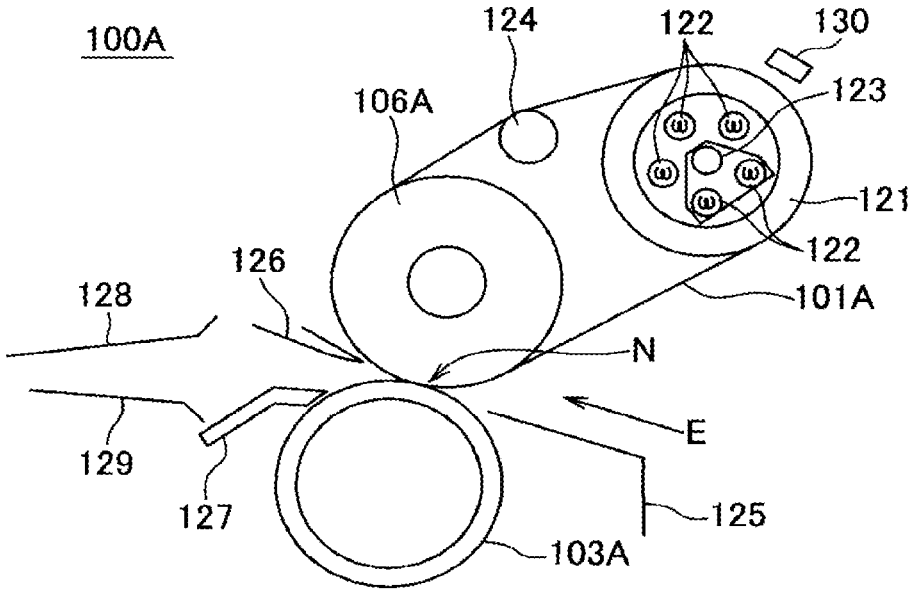
FIG. 2 is a schematic cross-sectional view of an example (a second embodiment) of a fixing device including a fixing belt according to an embodiment of the present disclosure.
Figure 3:
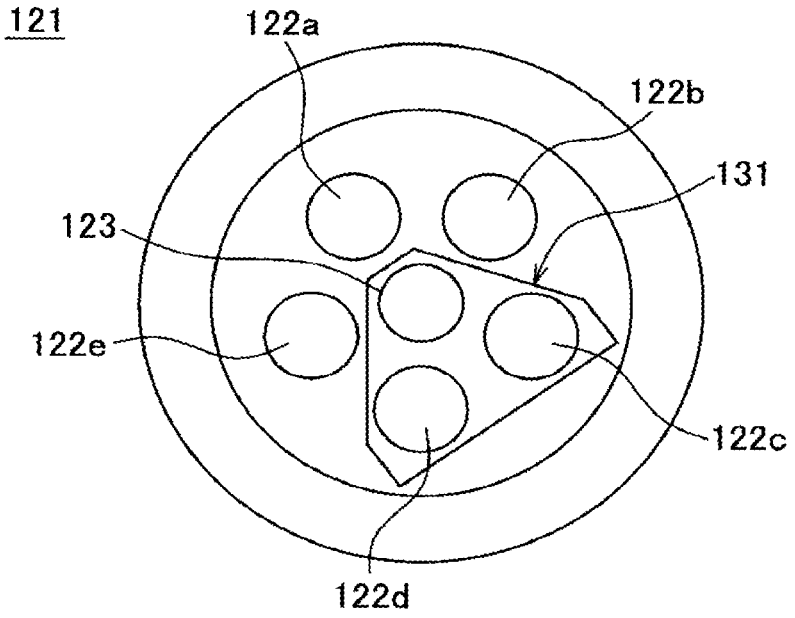
FIG. 3 is an enlarged cross-sectional view of a heating roller illustrated in FIG. 2.
Figure 4:
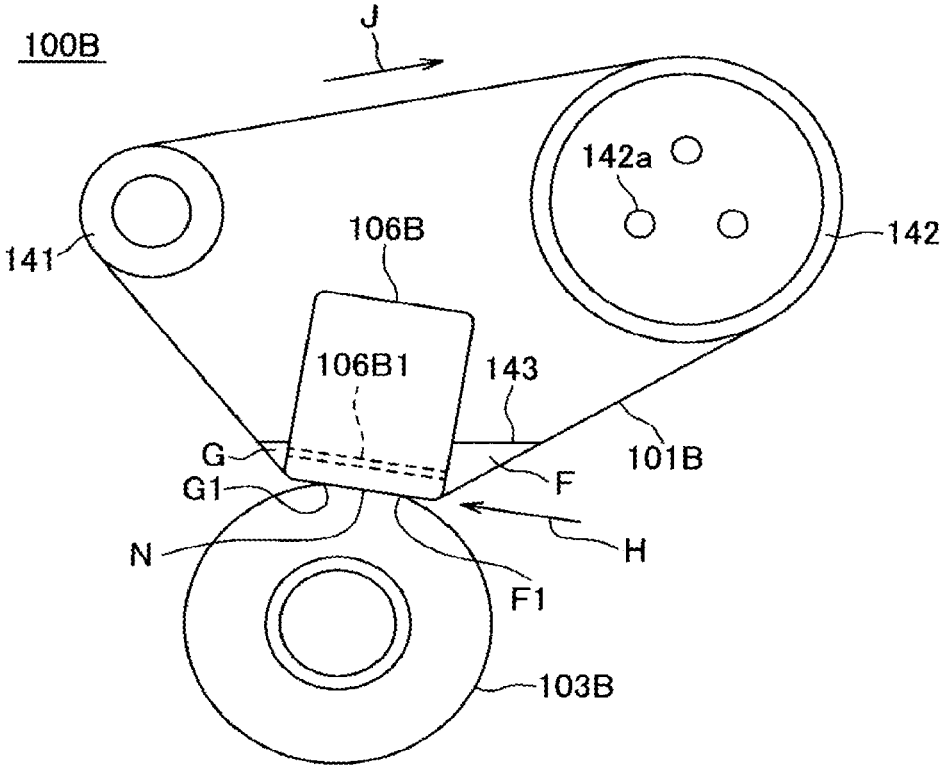
FIG. 4 is a schematic cross-sectional view of an example (a third embodiment) of a fixing device including a fixing belt according to the embodiment of the present disclosure.

A description is given of a fixing belt according to an embodiment of the present disclosure with reference to FIGS. 1, 2, 3, and 4. A fixing belt 101 according to the present embodiment can be applied to an image forming apparatus or a fixing device using an electrophotographic method. For example, the fixing belt 101 can be used for fixing devices 100 (FIG. 1), 100A (FIG. 2), and 100B (FIG. 3), and an image forming apparatus 500 (FIG. 4).

The fixing belt 101 according to the present embodiment is a single-layer belt formed of a polyimide layer including polyimide. The polyimide layer contains an aprotic solvent. The aprotic solvent has a boiling point not lower than 230° C., and a solubility parameter (SP value) not less than 24.5 $(J/cm^3)^{1/2}$ and not greater than 30.7 $(J/cm^3)^{1/2}$. Further, in the polyimide layer, the content of the solvent is not lower than 0.1 ppm and not higher than 1000 ppm. The boiling point in this disclosure indicates a boiling point at 1 atm (101325 Pa).

The solvent included in the polyimide layer has a solubility parameter not less than 24.5 $(J/cm^3)^{1/2}$ and not greater than 30.7 $(J/cm^3)^{1/2}$, and is aprotic. In general, the solubility parameter of polyimide is about 20 $(J/cm^3)^{1/2}$ to about 35 $(J/cm^3)^{1/2}$. Therefore, the affinity between the solvent and the polyimide is high and the solvent acts as a buffer among polyimide molecules. Such a configuration restrains waviness of the fixing belt 101, and unevenness of the film thickness or generation of bubbles on a surface of the fixing belt 101 is restrained during production. As a result, the smoothness of the surface of the fixing belt 101 is improved. The solvent included in the polyimide layer has a boiling point not lower than 230° C. that is higher than a temperature (normally, 150° C. to 200° C.) at an image is fixed in an image forming apparatus. Therefore, even when the image is fixed in the image forming apparatus, the solvent contained in the polyimide layer does not evaporate and continues to remain in the polyimide layer. The solvent acts as a buffer among polyimide molecules and can maintain stable fixing performance for a long time. Further, a solvent having a boiling point about 300° C. or lower can be suitably used in consideration of evaporating the solvent in the production process. When the content of the solvent in the polyimide layer is not lower than 0.1 ppm and not higher than 1000 ppm, influence of the solvent on the mechanical strength of the fixing belt 101 can be reduced.

The solvent contained in the polyimide layer is preferably any one or a combination of two or more materials selected from a group consisting of a propylene carbonate, butylene carbonate, ethylene carbonate, formyl morpholine, diethyl sulfone, ethyl methyl sulfone, methyl propyl sulfone, ethyl isopropyl sulfone, 3-methyl sulfolane, 2,4-dimethyl sulfolane, and sulfolane. The use of the above described solvents enables the solvent included in the polyimide layer to have a boiling point not lower than 230° C., and a solubility parameter not less than 24.5 $(J/cm^3)^{1/2}$ and not greater than 30.7 $(J/cm^3)^{1/2}$, and to be an aprotic solvent.

The fixing belt 101 may include conductive particles. The conductive particles may not be limited to specific materials. For example, a metal oxide, a carbon black, an ion conductive material, or a conductive polymer material and the like may be used. Since the fixing belt 101 contains the conductive particles, the fixing belt 101 is provided with a charging property, thus preventing charging of the fixing belt 101 from being restrained. Accordingly, a recording material (sheet) and the fixing belt 101 are prevented from being electrostatically attracted. As a result, the recording material can be stably discharged.

Examples of metal oxide includes, for example, zinc oxide, tin oxide, titanium oxide, zirconium oxide, aluminum oxide, and silicon oxide. In order to enhance dispersiveness, surface treatment may be applied to the above-described metal oxides in advance. Examples of the carbon blacks include ketjen black, furnace black, acetylene black, thermal black, and gas black. Examples of the ion conductive materials include tetraalkylammonium salt, trialkyl benzyl ammonium salt, alkyl sulfonic acid, alkylbenzene sulfonate, alkylsulfate, glycerin fatty acid ester, sorbitan fatty acid ester, polyoxyethylene alkylamine, polyoxyethylene fatty alcohol ester, alkyl betaine, and lithium perchlorate. Examples of conductive polymer materials include polyaniline and the like. Only one type of conductive particles may be used, or a plurality of types of conductive particles may be used in combination as needed.

The fixing belt 101 may include other additives such as a dispersing aid, a reinforcing material, a lubricant, a heat conductive material, and an antioxidant, depending on desired properties.

It is desirable that the average thickness of the polyimide layer of the fixing belt 101 is not less than 60 μm and not greater than 140 μm. The average thickness of the polyimide layer of the fixing belt 101 being not less than 60 μm and not greater than 140 μm can secure the strength and sufficient heat conductivity of the fixing belt 101. For example, in the case of a fixing belt having a three-layer structure including a polyimide layer, an elastic layer, and a release layer, such as the fixing belt 101A described later, the thickness of the entire fixing belt may be about 400 μm to 500 μm. The average thickness of the polyimide layer of the fixing belt 101 is an average value of values measured at arbitrary 10 points of the fixing belt 101. For measuring the thickness of the polyimide layer, general-purpose products such as a pointer type film thickness meter or an eddy current type film thickness meter can be used. For example, an electric micrometer manufactured by Anritsu Corporation can be used.

The fixing belt 101 is rotatable, for example, in a conveyance direction of a recording material, and may be endless.

Polyimide included in the polyimide layer is not particularly limited, and aromatic polyimide can be suitably used. Aromatic polyimide is obtained, for example, through reaction between an aromatic polycarboxylic anhydride or a derivative thereof and an aromatic diamine via a polyamic acid (polyimide precursor). Aromatic polyimide is insoluble in solvents due to rigid main chain structure of the polyimide and has infusibility. Therefore, polyimide precursor (polyimide acid), which is soluble in organic solvent, is first obtained through reaction between an aromatic polycarboxylic anhydride and an aromatic diamine. Molding is performed by various methods in a process in which the polyamic acid is obtained, and the molded polyamic acid is dehydrated by heating or a chemical method to be cyclized (imidized) to obtain a polyimide. Imidization by heating is a method of converting a polyamic acid into polyimide by heat treatment at, for example, 200° C. to 350° C., and is a simple and practical method to obtain a polyimide (polyimide resin). Polyamic acid is a precursor of polyimide included in the fixing belt 101 of the present embodiment. Polyamic acid can be produced by a known method using the above-mentioned solvent contained in the polyimide layer of the fixing belt 101 as a solvent in a polymerization reaction.

A detailed description is given of an example of a method of producing the fixing belt 101 according to the present embodiment.

First, a polyimide precursor and a coating solution containing the above-described solvent are applied to an outer surface of a mold (support) of a cylindrical fixing belt to form a coating film containing the polyimide precursor. Next, a cylindrical mold is heated to heat the formed coating film and to convert the polyimide precursor of the coating film into a polyimide resin, and further to evaporate the solvent included in the coating film. At this time, the solvent in the polyimide is adjusted to not less than 0.1 ppm and not greater than 1000 ppm. Finally, the polyimide resin is released from the cylindrical mold. The released polyimide resin becomes the fixing belt 101, and the fixing belt 101 is produced as described above.

Next, a detailed description is given of an example of above-described steps of producing the fixing belt 101.

A metal mold can be used as the cylindrical mold of the fixing belt 101. While slowly rotating the mold, a coating solution containing the polyimide precursor is applied to an entire outer surface of the cylindrical metal mold using a liquid supply device such as a nozzle or a dispenser to cast the coating solution (forming a coating film). Thereafter, the rotation speed is increased to a predetermined speed, and when the rotation speed reaches the predetermined speed, the rotation speed is maintained at a constant speed, and the rotation is continued for a desired time. Then, the temperature is gradually raised while rotating the mold, and the solvent in the coating film is evaporated at a temperature between 80° C. and 150° C. In this process, it is preferable to efficiently circulate and remove the vapor (evaporated solvent and the like) in the atmosphere.

When a film having self-supporting properties is formed, the temperature is further raised stepwise, and finally a high-temperature heat treatment (baking) is performed at about 200° C. to 350° C. Thus, imidization (conversion) of the polyimide precursor is performed. At this time, preferably the metal mold is heated from inside the metal mold to adjust the solvent in the polyimide within a range not less than 0.1 ppm and not greater than 1000 ppm. Any heater may be used as long as such a heating method can be applied. Specific examples of the heat source include a halogen heater and an induction heater (1H heater).

By using a method in which the coating liquid is applied on the outer surface of the mold and heated from the inside of the mold, the solvent can be more efficiently controlled within the above-described range. The method of heating the mold is classified into a method of heating from the outer surface of the cylindrical mold and a method of heating from the inside of the cylindrical mold, and can be appropriately selected depending on the purpose. In order to obtain the fixing belt of the present embodiment, it is effective to apply a coating solution containing a polyimide precursor to the outer surface of a cylindrical mold and heat the inside of the mold.

The method of producing the fixing belt is not limited to the above-described method and other methods can be selected appropriately depending on the purpose. As described above, a coating solution, such as a polyimide precursor solution (polyamic acid solution) dispersed with other additives, such as conductive particles, a dispersing aid, a reinforcing material, a lubricant, a heat conductive material, and an antioxidant, may be used depending on desired properties.

The mold is not particularly limited and may be appropriately selected depending on the purpose. For example, there is a cylindrical metal mold or the like, and a polyimide precursor solution is applied to an outer surface or an inner surface of the mold. Since it is easy to adjust the solvent in the polyimide within a range not less than 0.1 ppm and not greater than 1000 ppm, the polyimide precursor solution is preferably applied to the outer surface of the metal mold.

The solvent contained in the produced fixing belt 101 can be analyzed by a thermal extraction gas chromatograph mass spectrometry (thermal extraction GC/MS method). A sample cut out from an arbitrary portion of the fixing belt 101 can be used for the analysis. A commercially available thermal extraction GC/MS spectrometer, for example, GCMS-QP2010 by Shimadzu Corporation, can be used for the analysis.

The fixing belt 101 according to the present embodiment includes a polyimide layer containing polyimide. The polyimide layer contains an aprotic solvent. The aprotic solvent has a boiling point not lower than 230° C. and a solubility parameter not less than 24.5 $(J/cm^3)^{1/2}$ and not greater than 30.7 $(J/cm^3)^{1/2}$. The content of the solvent is not less than 0.1 ppm and not greater than 1000 ppm in the polyimide layer. Owing to this structure, the fixing belt 101 has a highly smooth surface and can restrain image unevenness in a fixing device not only initially but also over a long period of time and provide high image quality.

In the present embodiment, the fixing belt 101 has a single polyimide layer. However, the layer configuration of the fixing belt of the present disclosure is not limited to the above-described configuration, and the fixing belt may have a plurality of layers. When the fixing belt 101 has a plurality of layers, a plurality of polyimide layers may be used, or a layer containing a material other than polyimide with the polyimide layer as a base material may be used. Examples of layer containing materials other than polyimide include an elastic layer containing an elastic material such as silicone rubber, tetrafluoroethylene-perfluoroalkoxy ethylene copolymer (PFA) facilitating separation of toner, and a release layer made of polytetrafluoroethylene (PTFE).

For example, a fixing device 100A of a second embodiment described later includes a fixing belt 101A having a three-layer structure. Specifically, the fixing belt 101A includes a polyimide layer, an elastic layer such as a silicone rubber layer formed outside the polyimide layer, and a PFA layer formed outside the silicone rubber layer. For example, a fixing device 100B of a third embodiment described later includes a fixing belt 101B having a two-layer structure. Specifically, the fixing belt 101B includes a polyimide layer and an elastic layer such as a silicone rubber layer formed outside the polyimide layer.

Fixing Device (First Embodiment)

Next, a description is given of a fixing device according to the first embodiment of the present disclosure with reference to FIG. 1. A fixing device 100 according to the present embodiment is a sliding-type fixing device that can be used for an image forming apparatus using an electrophotographic method and includes the above-described fixing belt 101. The fixing device 100 can be used, for example, for an image forming apparatus 500 (FIG. 5) described later. Note that the configuration of the fixing belt 101 is not limited to the above-described configuration as long as it is the fixing belt described in the above sub-section of "Fixing Belt", and a fixing belt having another configuration may be used.

The fixing device 100 according to the present embodiment includes the fixing belt 101, a nip forming member 106 disposed inside an inner circumferential surface of the fixing belt 101, and a pressure roller 103 serving as a pressure member to press a recording material against the fixing belt 101. In the fixing device 100, lubricant is applied between the nip forming member 106 and the fixing belt 101.

The fixing device 100, as illustrated in FIG. 1, includes the fixing belt 101 as a fixing member and the pressure roller 103 disposed opposite the fixing belt 101 as a rotatable pressure member. Two halogen heaters 102, that is, a first halogen heater 102A and a second halogen heater 102B, serve as a plurality of fixing heating sources that heats the fixing belt 101 in a non-nip portion. The two halogen heaters 102 heat the inner circumferential surface of the fixing belt 101 directly with radiant heat. The fixing belt 101 is endless and rotatable in a rotation direction indicated by arrow C in FIG. 1. In FIG. 1, arrow B indicates a direction of conveyance of the recording material (sheet), arrow C indicates the rotation direction of the fixing belt 101, and arrow D indicates a rotation direction of the pressure roller 103.

Inside a loop of the fixing belt 101 of the fixing device 100 illustrated in FIG. 1, the nip forming member 106 is disposed to form a nip N between the fixing belt 101 and the pressure roller 103. The nip forming member 106 slides over an inner surface of the fixing belt 101 and a thermal conduction aid 110. Then, a toner image on a sheet as a recording material is fixed in the nip N under heat and pressure.

In the example illustrated in FIG. 1, a portion of the thermal conduction aid 110 facing the fixing belt 101 has a flat shape. In some embodiments, the portion of the thermal conduction aid 110 may have a concave shape or other shapes. If the nip N has a concave shape, an ejection direction of a leading edge of the recording material directs toward the pressure roller 103, thus facilitating separation of the recording material and restraining jamming of the recording material. The thermal conduction aid 110 serves as a portion of the nip forming member 106 facing the fixing belt 101.

Inside the loop of the fixing belt 101, the nip forming member 106 and two end heaters (a left end heater 111*a* and a right end heater 111*b*) are disposed. The nip forming member 106 is arranged at a position facing the pressure roller 103. The two end heaters are disposed at both ends of the nip forming member 106 and serves as end heat generation sources to heat the fixing belt 101 at the nip N. The fixing belt 101 also includes the thermal conduction aid 110 and a stay 107. The thermal conduction aid 110 covers a surface of each of the nip forming member 106, the left end heater 111*a*, and the right end heater 111*b* that faces the inner surface of the fixing belt 101. The stay 107 supports the nip forming member 106 against a pressing force of the pressure roller 103. Further, the two end heaters, that is, the left end heater 111*a* and the right end heater 111*b* are separately provided at both ends in the longitudinal direction of the fixing belt 101, and do not have a continuous shape.

Each of the nip forming member 106, the thermal conduction aid 110, and the stay 107 has a length extending in a width direction (hereinafter referred to as "longitudinal direction") of the fixing belt 101. The thermal conduction aid 110 prevents heat generated by the left end heater 111*a* and the right end heater 111*b* from being stored locally and facilitates conduction of heat in the longitudinal direction of the fixing belt 101. Thus, the thermal conduction aid 110 reduces uneven temperature of the fixing belt 101 in the longitudinal direction. For this reason, the thermal conduction aid 110 is preferably made of a material that conducts heat quickly, for example, a material having an increased thermal conductivity such as copper, aluminum, or silver. It is preferable that the thermal conduction aid 110 is made of copper in a comprehensive view of manufacturing costs, availability, thermal conductivity, and processing. In the fixing device 100 of the present embodiment, the surface of the thermal conduction aid 110 facing the inner surface of the fixing belt 101 directly contacts the fixing belt 101 and serves as a nip formation surface.

The stay 107 has a shape including an upright portion that stands upright in an opposite side of the nip N. A first halogen heater 102A and a second halogen heater 102B as heat generation source for fixing are disposed opposite to each other across the upright portion. The two heaters, the first halogen heater 102A and the second halogen heater 102B heat the inner circumferential surface of the fixing belt 101 directly with radiation heat. Since the first halogen heater 102A and the second halogen heater 102B are disposed inside an inner circumference formed by the fixing belt 101, the size of the fixing device 100 including the fixing belt 101 can be easily made compact.

Inside the loop formed by the fixing belt 101, the stay 107 is disposed serving as a support that supports the nip forming member 106 to form the nip N. As the nip forming member 106 receives pressure from the pressure roller 103, the stay 107 supports the nip forming member 106 to prevent bending of the nip forming member 106 and produce an even nip length in an axis direction of the pressure roller 103. The stay 107 is held and secured at both ends of the stay 107 by flanges serving as a holder and positioned. A reflector 109 is interposed between the two halogen heaters 102 and the stay 107 to prevent the stay 107 from being heated with the radiation heat from each of the two halogen heaters 102, thus reducing waste of energy. Instead of providing the reflector 109, a surface of the stay 107 may be insulated or given a mirror finish to reflect the radiation heat to gain a similar effect.

The pressure roller 103 includes a core bar 105 and an elastic rubber layer 104 resting on the core bar 105. A surface release layer (PFA or PTFE layer) resting on the elastic rubber layer 104 is provided to facilitate separation of the recording material from the pressure roller 103. As a driving force generated by a driver (e.g., a motor) situated inside the image forming apparatus 500 is transmitted to the pressure roller 103 through a gear train, the pressure roller 103 rotates. The pressure roller 103 is pressed against the fixing belt 101 by a spring or the like, and the elastic rubber layer 104 is compressed and deformed to obtain a predetermined nip width.

The pressure roller 103 may be a hollow roller. Alternatively, the pressure roller 103 may include a heating source such as a halogen heater. The elastic rubber layer 104 may be made of solid rubber. Alternatively, if no heater is situated inside the pressure roller 103, the elastic rubber layer 104 may be made of sponge rubber. The sponge rubber is preferable to the solid rubber because the sponge rubber has enhanced thermal insulation that draws less heat from the fixing belt 101.

In the example illustrated in FIG. 1, as a driver drives and rotates the pressure roller 103, a driving force of the driver is transmitted to the fixing belt 101 through the nip N, thus rotating the fixing belt 101 by friction between the pressure roller 103 and the fixing belt 101. The fixing belt 101 rotates, as the fixing belt 101 is sandwiched at the nip N between the pressure roller 103 and the nip forming member 106. At a circumferential span of the fixing belt 101 other than at the nip N, the fixing belt 101 rotates while the fixing belt 101 is guided by the flange at each lateral end of the fixing belt 101. With the configuration described above, the fixing device 100 having quick warm-up can be manufactured at a reduced cost. The fixing device 100 according to the present embodiment includes the fixing belt 101. The fixing belt 101 has a highly smooth surface and can restrain image unevenness in the fixing device 100 (fixing unit) not only initially but also over a long period of time and provide high image quality.

Embodiment 2

Next, a description is given of a fixing device according to a second embodiment of the present disclosure with reference to FIGS. 2 and 3. A fixing device 100A of the present embodiment is a fixing device that can be used for an image forming apparatus using an electrophotographic method and includes the above-described fixing belt 101A. The fixing device 100A can be used, for example, for an image forming apparatus 500 (FIG. 5) described later.

The fixing device 100A according to the present embodiment includes the fixing belt 101A, a fixing roller 106A, a pressure roller 103A, a heating roller 121, an infrared heater 122, a heating adjuster 123, a tension roller 124, an entry guide 125, a separation plate 126, a separation claw 127, an upper exit guide 128, a lower exit guide 129, and a temperature sensor 130. The fixing roller 106A is disposed inside an inner circumferential surface of the fixing belt 101A and serves as a nip forming member. The pressure roller 103A is a pressing member that presses a recording material toward the fixing belt 101A. In FIG. 2, arrow E indicates a direction of conveyance of the recording material (sheet).

The heating roller 121 serves as a heating roller that heats the fixing roller 106A. The heating roller 121 is a tubular hollow roller made of, for example, aluminum or iron. The heating roller 121 is disposed opposite the fixing roller 106A with an interval between the heating roller 121 and the fixing roller 106A such that a shaft of the heating roller 121 is parallel to a shaft of the fixing roller 106A. Inside the heating roller 121, a plurality of infrared heaters 122 and the heating adjuster 123 are arranged. That is, the heating roller 121 serves as a heater that is a tubular rotator accommodating the infrared heaters 122 and the heating adjuster 123.

FIG. 3 is an enlarged cross-sectional view of the heating roller 121. As illustrated in FIG. 3, inside the heating roller 121, five infrared heaters 122*a*, 122*b*, 122*c*, 122*d*, and 122*e*, as the infrared heater 122, are arranged. Further, the heating adjuster 123 is disposed inside the heating roller 121.

The infrared heaters 122 are heaters that are tubular and extended in a longitudinal direction of the heating roller 121. A wiring or the like is coupled to both ends or one end of each of the infrared heaters 122 to supply power to each of the infrared heaters 122. As one example of the present embodiment, each of the infrared heaters 122 has a rated power of 1000 W and a diameter of 8 mm (φ8). In this example, while the sheet is conveyed, at maximum, the five infrared heaters 122 are powered on simultaneously to attain a total rated power of 5000 W obtained by multiplying 1000 W by 5.

The five infrared heaters 122*a*, 122*b*, 122*c*, 122*d*, and 122*e* are arranged along an inner circumferential surface of the heating roller 121 having a predetermined circumference such that the infrared heaters 122*a*, 122*b*, 122*c*, 122*d*, and 122*e* are evenly spaced with each other with an even interval between the adjacent infrared heaters 122 in cross-section. As one example of the present embodiment, the interval between the adjacent infrared heaters 122 is 3.75 mm. In the present embodiment, the number of the infrared heaters 122 is five. However, the number of the infrared heaters 122 is not limited to five and may be two or more as long as the infrared heaters 122 are situated inside the heating roller 121.

According to the present embodiment, the infrared heaters 122 are used as the plurality of heaters. Alternatively, other heaters such as halogen heaters may be used as the plurality of heaters. Additionally, the heater may not be tubular. For example, the heater may be rectangular, platy, or the like in cross-section. That is, the heater may have any other shape as long as the heater extends in the longitudinal direction of the heating roller 121.

The heating adjuster 123 is made of glass, tubular, and extended in the longitudinal direction of the heating roller 121. That is, the heating adjuster 123 is a hollow tube. The hollow tube of the heating adjuster 123 is filled with gas such as air and nitrogen. As one example of the present embodiment, the heating adjuster 123 has a diameter of 6 mm (φ6). The heating adjuster 123 is disposed at a center inside the heating roller 121. That is, an even and minimum distance is provided between the heating adjuster 123 and each of the infrared heaters 122*a*, 122*b*, 122*c*, 122*d*, and 122*e*. Since a projection may be produced on the heating adjuster 123 due to molding, the heating adjuster 123 may be slightly shifted from a position that defines the even and minimum distance between the heating adjuster 123 and each of the infrared heaters 122*a*, 122*b*, 122*c*, 122*d*, and 122*e*. However, the heating adjuster 123 is disposed at a position to meet the above-described condition (even and minimum distance) to the utmost.

The heating adjuster 123 does not generate heat (non-heat generator) and absorbs heat generated by the infrared heaters 122 that surround the heating adjuster 123. Heat absorbed by the heating adjuster 123 is cooled at or exhausted from both ends of the heating adjuster 123 in the longitudinal direction of the heating adjuster 123 by thermal conduction. Accordingly, for example, although the infrared heater 122*a* is heated directly by the adjacent infrared heaters 122*b* and 122*e*, the infrared heater 122*a* is heated less by the infrared heaters 122*c* and 122*d* that are disposed opposite the infrared heater 122*a* across the heating adjuster 123. Consequently, the infrared heater 122*a* is less likely to exceed a specified temperature (heat resistance temperature). That is, the heating adjuster 123 interposed between the plurality of infrared heaters 122 absorbs heat from the infrared heaters 122, thus performing adjustment to prevent one infrared heater 122 from overheating another infrared heater 122.

The plurality of infrared heaters 122 and the heating adjuster 123 do not need to be aligned on a straight line. Alternatively, as illustrated in FIG. 3, at least a part of the heating adjuster 123 may block heat from one infrared heater 122.

Although the temperature inside the heating roller 121 varies depending on the output from the infrared heaters 122 and the number of the infrared heaters 122, the temperature inside the heating roller 121 may increase to about 900° C., for example. To address such a circumstance, the heating adjuster 123 may be made of quartz glass that does not melt at 900° C. and barely expands thermally. Alternatively, the heating adjuster 123 may be made of other glass material or other heat resistant material that does not melt at 900° C. and barely expands thermally, which is selected according to the temperature inside the heating roller 121. Other glass material includes Neoceram (registered trademark) and Pyrex (registered trademark), for example. Instead of glass, the heating adjuster 123 may be made of other heat resistant material such as ceramics as long as the heat resistant material has a small thermal conductivity and prevents sharp temperature increase of the heating adjuster 123.

As the five infrared heaters 122*a*, 122*b*, 122*c*, 122*d*, and 122*e*, disposed opposite each other densely in the heating roller 121, as in a case of the present embodiment, receives radiation heat from each of the infrared heaters 122, the glass tube of the infrared heater 122, which is made of quartz glass, may be heated to a temperature higher than a heat resistant temperature of the quartz glass and suffer from blackening. Each of the five infrared heaters 122*a*, 122*b*, 122*c*, 122*d*, and 122*e* is a heater including a glass tube having a diameter of 8 mm (φ8). An interval in a range of from about 3 mm to about 4 mm is provided between a surface of one glass tube and a surface of an adjacent glass tube of the five infrared heaters 122*a*, 122*b*, 122*c*, 122*d*, and 122*e*. The heat-resistant temperature of the quartz glass tube is 900° C. (operating temperature upper limit is 850° C.). If a halogen heater is used, the halogen heater may suffer from usage outside a halogen cycle. In other words, in the example described above, the infrared heaters 122 suffer from blackening at a rated power of equal to or higher than about 5000 W. Thus, the heating adjuster 123 is used. In a case of the heating adjuster 123 according to the present embodiment having a diameter of 6 mm (φ6), an interval in a range of from about 4 mm to about 5 mm (e.g., in a range not smaller than 4 mm and not greater than 5 mm) is provided between the surface of one glass tube and the surface of the adjacent glass tube of the five infrared heaters 122.

In FIG. 3, the diameter of the heating adjuster 123 is smaller than the diameter of each of the infrared heaters 122. Alternatively, the diameter of the heating adjuster 123 may be the same as the diameter of each of the infrared heaters 122 or the diameter of the heating adjusters 123 may be larger than the diameter of each of the infrared heaters 122. The shape of the heating adjuster 123 in cross-section is not limited to a circular shape and may be polygonal. For example, since the present embodiment includes the five infrared heaters 122, the heating adjuster 123 may be a pentagon in which five sides or five vertexes are disposed opposite the five infrared heaters 122, respectively.

According to the present embodiment, as illustrated in FIG. 3, the infrared heaters 122*c* and 122*d* and the heating adjuster 123 are integrated as a combined unit 131 with a joint.

Each of the infrared heaters 122*c* and 122*d* includes a heater and sealing portions. The heating portion generates heat. The sealing portions are coupled to both end portions of the heaters. The heating adjuster 123 includes an adjusting portion and a sealing portion. The adjusting portion adjusts heating and adjust heat conduction in accordance with the heating roller 121. The sealing portions are coupled to both end portions of the adjusting portions.

The joint includes a through-hole into which each of the sealing portions is inserted so that the sealing portions are secured to the joint with the above-described distance that is provided between the infrared heaters 122*c* and 122*d* and the heating adjuster 123. The joint combines the infrared heaters 122*c*, 122*d*, and the heating adjuster 123 at each lateral end of the infrared heaters 122*c* and 122*d* and the heating adjuster 123 in the longitudinal direction thereof. Although the joint is not directly heated by the infrared heaters 122*c* and 122*d*, since the joint is disposed in proximity to the infrared heaters 122*c* and 122*d* and heated to a high temperature, the joint is made of a material that is resistant to the high temperature.

The joint may combine other infrared heaters 122 with the heating adjuster 123. For example, the joint may combine the infrared heaters 122*a* and 122*b* with the heating adjuster 123. That is, one or more infrared heaters 122 and the heating adjuster 123 may be combined. Alternatively, the joint may have any shape other than the shape illustrated in FIG. 3 as long as the joint retains the positional relation of the joint with respect to the infrared heaters 122 and the heating adjuster 123. Alternatively, the joint may combine the infrared heaters 122 and the heating adjuster 123 at one lateral end instead of both lateral ends thereof in the longitudinal direction.

The fixing roller 106A is a tubular roller constructed of a core bar made of aluminum, iron, or the like and an elastic layer coating the core bar and being made of silicone rubber or the like, for example. Alternatively, the elastic layer may be made of silicone rubber foam to reduce heat absorbed from the fixing belt 101A into the fixing roller 106A and thereby shorten a warm-up time to warm up the fixing belt 101A. The fixing roller 106A is a tubular rotator that is driven and rotated by a driver including a motor, a gear and the like.

The tension roller 124 is a tubular roller that applies an appropriate tension to the fixing belt 101A. The appropriate tension is determined to attain a friction that prevents an inner circumferential surface of the fixing belt 101A from sliding over an outer circumferential surface of the heating roller 121 and the fixing roller 106A.

The fixing belt 101A is an endless belt looped over the heating roller 121 and the fixing roller 106A. As described above, the fixing belt 101A has a cross-sectional structure of three layers, namely, a polyimide layer, an elastic layer such as a silicone rubber layer formed outside the polyimide layer, and a PFA layer formed outside the silicone rubber layer. The fixing belt 101A is looped over and stretched taut across the heating roller 121 and the fixing roller 106A with a predetermined tension. As described above, the tension roller 124 applies the appropriate tension to the fixing belt 101A to attain the friction that prevents the inner circumferential surface of the fixing belt 101A from sliding over the outer circumferential surface of the heating roller 121 and the fixing roller 106A. Hence, as the driver drives and rotates the fixing roller 106A, the fixing roller 106A rotates the fixing belt 101A. Thus, the heating roller 121 is driven and rotated as a driven roller. Note that the configuration of the fixing belt 101A is not limited to the above-described configuration as long as it is a fixing belt described in the above sub-section of "Fixing Belt", and a fixing belt having another configuration may be used.

The pressure roller 103A is a pressing roller to press against the fixing roller 106A. The pressure roller 103A is a tubular roller constructed of a core bar made of metal such as aluminum and iron and an elastic layer coating the core bar and being made of silicone rubber or the like, for example. The pressure roller 103A is rotatably arranged. An outer circumferential surface of the pressure roller 103A is pressed against the fixing roller 106A via the fixing belt 101A. The pressure roller 103A is pressed against the fixing roller 106A via the fixing belt 101A to form a nip N between the pressure roller 103A and the fixing belt 101A. Thus, the pressure roller 103A serves as a pressing member and the fixing roller 106A serves as a nip formation member and a fixing rotator.

The entry guide 125 is a plate that guides the sheet as a recording material bearing an unfixed toner image to the nip N.

The separation plate 126 prevents the sheet from being wound around the fixing belt 101A and separates the sheet from the fixing belt 101A. The separation claw 127 prevents the sheet from being wound around the pressure roller 103A and separates the sheet from the pressure roller 103A.

The upper exit guide 128 is a plate that guides the sheet bearing the toner image fixed on the sheet while the sheet is conveyed through the nip N to an output tray or the like. The lower exit guide 129 is a plate that guides the sheet bearing the toner image fixed on the sheet while the sheet is conveyed through the nip N to the output tray or the like. The upper exit guide 128 and the lower exit guide 129 guide the sheet to the output tray or the like while the upper exit guide 128 and the lower exit guide 129 sandwich the sheet.

The temperature sensor 130 is disposed in proximity to an outer circumferential surface of the fixing belt 101A. The temperature sensor 130 detects the temperature of the outer circumferential surface of the fixing belt 101A. The infrared heaters 122 are controlled based on the detected temperature of the fixing belt 101A.

In the fixing device 100A having the configuration described above, the temperature sensor 130 detects the temperature of the outer circumferential surface of the fixing belt 101A. Based on the temperature of the outer circumferential surface of the fixing belt 101A detected by the temperature sensor 130, the infrared heaters 122 are controlled to adjust the temperature of the outer circumferential surface of the fixing belt 101A to a predetermined temperature. For example, the control is performed by turning on and off all the infrared heaters 122 simultaneously.

The infrared heaters 122 heat the heating roller 121 that in turn heats the fixing belt 101A. The fixing roller 106A drives and rotates the heated fixing belt 101A.

The sheet bearing the unfixed toner image, after entering the fixing device 100A, is guided by the entry guide 125 and conveyed through the nip N where the unfixed toner image melts and is fixed, and is sent out to the output tray and the like from between the upper exit guide 128 and the lower exit guide 129.

The fixing device 100A according to the present embodiment includes the fixing belt 101A. Accordingly, the fixing belt 101A has a highly smooth surface and can restrain image unevenness in the fixing device 100A (fixing unit) not only initially but also over a long period of time and provide high image quality.

The heating adjuster 123 is integrated with the plurality of infrared heaters 122*c* and 122*d* as a combined unit 131. Owing to this structure, the combined unit 131 is assembled separately from assembly of the fixing device 100A, preventing the heating adjuster 123 from coming into contact with the infrared heaters 122*c* and 122*d*. When the fixing device 100A is assembled, the combined unit 131 that has been assembled is installed into the fixing device 100A, preventing the heating adjuster 123 from coming into contact with the infrared heaters 122*c* and 122*d* and facilitating installation of the combined unit 131 into the fixing device 100A during assembly of the fixing device 100A.

The heating adjuster 123 and the plurality of infrared heaters 122*c* and 122*d* are integrated with the joint at each end of the heating adjuster 123 and the infrared heaters 122*c* and 122*d* in the longitudinal direction thereof without adversely affecting heating by the infrared heaters 122*c* and 122*d* and heating adjustment by the heating adjuster 123.

The heating adjuster 123 made of glass is disposed at a center inside the heating roller 121 of the fixing device 100A, surrounded by the infrared heaters 122 arranged along the inner circumferential surface of the heating roller 121. Owing to this structure, the heating adjuster 123 absorbs heat generated by the infrared heaters 122 and reduces heat conducted directly from other infrared heaters 122 disposed opposite the one infrared heater 122, thus decreasing overheating of the infrared heaters 122 to a temperature above the specified temperature. Consequently, the heating adjuster 123 can prevent thermal degradation of the infrared heaters 122. Hence, the heating adjuster 123 can extend the life of the infrared heaters 122.

The heating adjuster 123 is disposed with an even distance from each of the plurality of infrared heaters 122*a*, 122*b*, 122*c*, 122*d*, and 122*e*, thus allowing the temperature inside the heating roller 121 heated by the infrared heaters 122*a*, 122*b*, 122*c*, 122*d*, and 122*e* to be equalized.

The heating adjuster 123 is made of glass that has a lower thermal conductivity, thus restraining a sharp temperature increase of the heating adjuster 123.

Quartz glass that has a substantially lower coefficient of thermal expansion is used for the heating adjuster 123 to reduce thermal expansion of the heating adjuster 123. Accordingly, the heating adjuster 123 can be arranged even in a small, for example, when the heating rollers 121 has a small diameter.

The fixing device 100A includes the fixing roller 106A and the pressure roller 103A that is a rotator pressing against the fixing belt 101A. The fixing roller 106A and the pressure roller 103A form the nip N at a position in which the pressure roller 103A is pressed against the fixing roller 106A via the fixing belt 101A. Thus, the fixing device 100A as a belt fixing system can melt and fix the unfixed toner image for a short warm-up time.

The combined unit 131 is integrated with the joint. However, when the tube of each of the infrared heaters 122 and the heating adjuster 123 are made of an identical material such as glass, the infrared heaters 122 may be molded with the heating adjuster 123. In this case, instead of the shape of the joint illustrated in FIG. 3, the heating adjuster 123 may be coupled to and combined with each of the infrared heaters 122 through a column or the like with an interval between the heating adjuster 123 and each of the infrared heaters 122.

The heating adjuster 123 is described as a hollow tube. Alternatively, the heating adjuster 123 may have a solid rod shape and a similar heating adjustment effect can be obtained.

In FIG. 3, the number of the heating adjuster 123 is one. However, the number of the heating adjuster 123 may be plural. For example, a plurality of heating adjusters 123 may be arranged at a center of the heating roller 121. Alternatively, the plurality of heating adjusters 123 may be disposed adjacent to each other such that an even interval is provided between the center of the heating roller 121 in cross-section and each of the heating adjusters 123 and an equal interval is provided between the adjacent heating adjusters 123. In these cases, the size, position, and the like of the through-holes of the joint are modified according to the heating adjusters 123.

Embodiment 3

Next, a description is given of a fixing device according to a third embodiment of the current disclosure with reference to FIG. 4. A fixing device 100B of the present embodiment is a fixing device that can be used for an image forming apparatus using an electrophotographic method and includes the above-described fixing belt 101. The fixing device 100B can be used, for example, for the image forming apparatus 500 (FIG. 5) described later.

A description is provided of a configuration of the fixing device 100B.

The fixing device 100B according to the present embodiment includes a fixing belt 101B, a pressure pad 106B, a pressure roller 103B, a drive roller 141, and a heating roller 142. The pressure pad 106B as a nip forming member is disposed inside an inner circumferential surface of the fixing belt 101B. The pressure roller 103B serves as a pressure member to press a recording material against the fixing belt 101B. In FIG. 4, arrow H indicates a direction of conveyance of the recording material (sheet). The drive roller 141 includes a high friction resistance member such as rubber on the outer peripheral surface and is rotatably supported by side plates of the fixing device 100B. The drive roller 141 is driven by a motor to move the fixing belt 101B in the same direction (direction of arrow J in FIG. 4) as a direction in which the sheet is conveyed by the motor.

The heating roller 142 is a hollow roller made of aluminum or iron and rotatably supported by the above-described side plates of the fixing device 100B. The heating roller 142 is driven by the rotation of the fixing belt 101B. Inside the heating roller 142, heat generation sources 142*a* such as a halogen heater or the like are disposed. The fixing belt 101B is controlled to maintain a predetermined temperature after the fixing belt 101B is heated with the heat generated by the heat generation sources 142*a* until a temperature detected by the temperature detection sensor reaches a target temperature. The pressure roller 103B is disposed below the drive roller 141 and the heating roller 142. The pressure roller 103B rotatably supported by the side plates of the fixing device 100B, is driven to rotate as the fixing belt 101B rotates, and presses the sheet by a pressing force of a pressing member.

The pressure pad 106B is provided at a position facing the pressure roller 103B via the fixing belt 101B. The pressure pad 106B which presses against the pressure roller 103B via the fixing belt 101B to form a nip is made of Steel Use Stainless (SUS) 304 and has a sliding surface with a surface roughness of Ra 0.2. As the surface treatment of the sliding surface, verification tests are conducted on a fluorine resin coating, nickel composite plating containing 20% fluorine, and mounting of a sliding sheet and the like.

The fixing belt 101B is looped around the drive roller 141, the heating roller 142, and the pressure pad 106B with a predetermined tension. The fixing belt 101B includes, as described above, a polyimide layer and an elastic layer such as a silicone rubber layer formed outside the polyimide layer and has a two-layer structure. Note that the configuration of the fixing belt 101B is not limited to the above-described configuration as long as it is a fixing belt described in the above sub-section of "Fixing Belt", and a fixing belt having another configuration may be used.

Inside the fixing belt 101B, lubricant 143 is disposed at an upstream portion and a downstream portion, in the conveyance direction of the fixing belt 101B, from a contact portion at which the pressure roller 103B and the pressure pad 106B contact each other to form the nip N. The upstream portion and the downstream portion are an entrance portion F and an exit portion G, respectively, of the nip N in which the inner surface of the fixing belt 101B contacts the pressure pad 106B. The lubricant 143 is a lubricant that enhances slidability of the fixing belt 101B with respect to the sliding surface of the pressure pad 106B. As the lubricant 143, heat resistant oil such as silicone oil or fluorinated silicone oil can be applied, and among them, fluorine oil having excellent boundary lubricity is preferable. Further, a filter capable of collecting abrasion powder may be disposed at an arbitrary position of an oil circulation path. At both ends of the fixing belt 101B in the width direction of the sheet, wall portions are provided to prevent the lubricant 143 from leaking from the inside of the fixing belt 101B.

A plurality of through holes 106B1 is provided in a lower portion of the pressure pad 106B so as to be substantially parallel to the nip N. In the present embodiment, the through holes 106B1 are formed at 20 positions in the width direction of the sheet. The pressure pad 106B is disposed such that an exit G1 of the nip portion, which is a contact portion with the pressure roller 103B, is positioned above an entrance F1 in the vertical direction, that is, is inclined rightward. With the above-described configuration, the lubricant 143 supplied between the inner surface of the fixing belt 101B and the sliding surface of the pressure pad 106B moves from the entrance F to the exit G, and then returns to the entrance F again through each of the through holes 106B1, and can be supplied again. In the above-described configuration, each through hole 106B1 functions as a circulator and a lubricant circulation path.

The fixing device 100B of the present embodiment includes the fixing belt 101B Accordingly, the fixing belt 101B has a highly smooth surface and can restrain image unevenness in the fixing device 100B (fixing unit) not only in the initially but also for a long period of time and provide high image quality.

Image Forming Apparatus

Next, an image forming apparatus according to an embodiment of the present disclosure is described with reference to FIG. 5. The image forming apparatus 500 of the present embodiment uses an electrophotographic method, and includes the fixing belt 101 and the fixing device 100 described above. The image forming apparatus according to an embodiment of the present disclosure may include any other fixing device including the fixing belt 101, and may include, for example, the fixing device 100A or the fixing device 100B described above instead of the fixing device 100.

Figure 5:
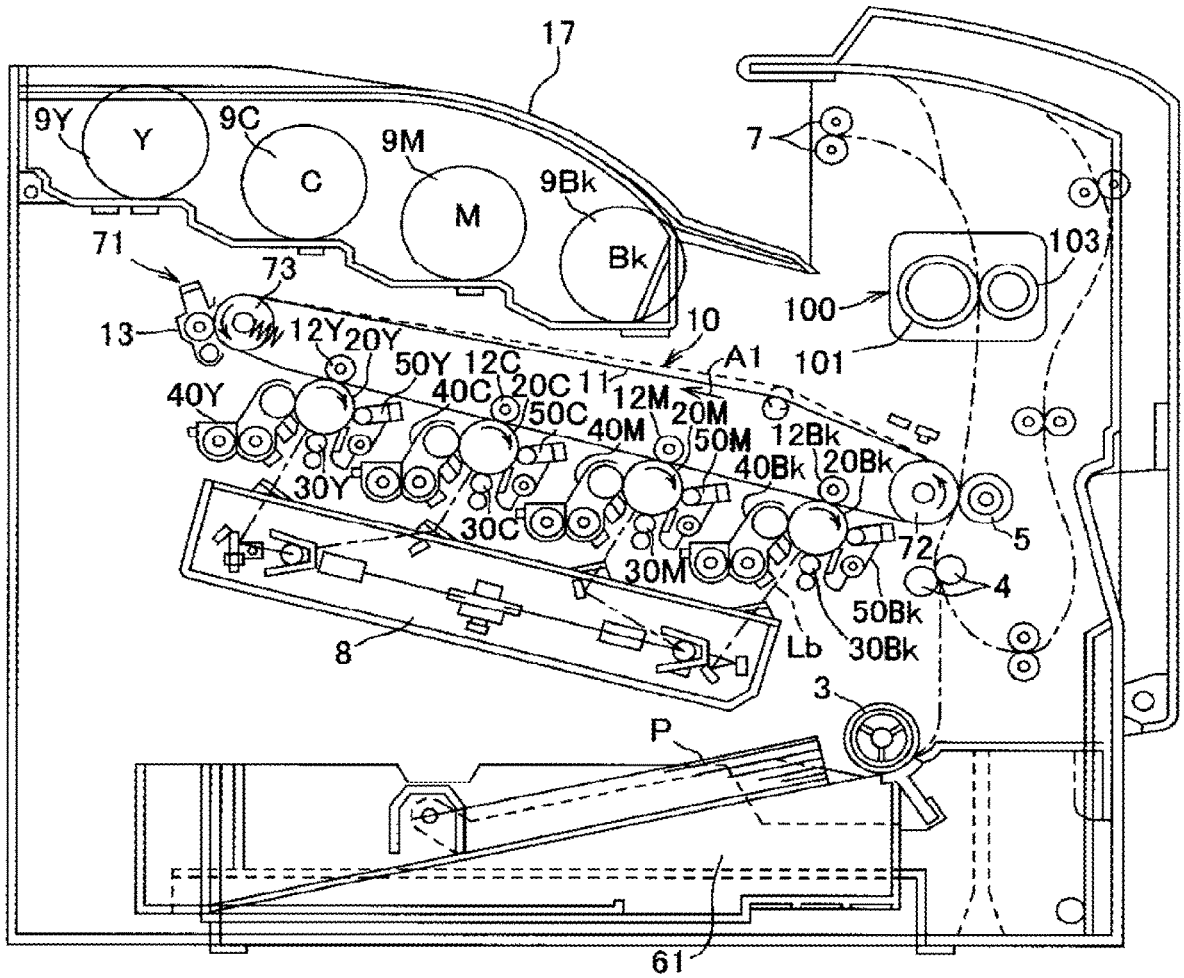
FIG. 5 is a schematic cross-sectional view of an image forming apparatus according to an embodiment of the present disclosure.

FIG. 5 is a schematic view illustrating an example of an entire configuration of the image forming apparatus 500 according to an embodiment of the present disclosure. In the present embodiment, the image forming apparatus 500 includes an image forming unit for a tandem color printer. However, in some embodiments, the image forming apparatus may be a rotary-type color printer or monochrome printer. The image forming apparatus is not limited to a printer, and may be any suitable type of image forming apparatus such as a printer, a copying machine, a facsimile machine, or a multifunction peripheral thereof using an electrophotographic method.

The image forming apparatus 500 employs a tandem structure in which photoconductive drums 20Y, 20C, 20M, and 20Bk as image bearers capable of forming images corresponding to colors separated into yellow, cyan, magenta, and black, respectively, are arranged side by side. In the image forming apparatus 500, visible images formed of toner images on the photoconductive drums 20Y, 20C, 20M, and 20Bk are primarily transferred onto a transfer belt 11. The transfer belt 11 is an intermediate transfer member formed of an endless belt movable in a direction of arrow A1 while facing the photoconductive drums 20Y, 20C, 20M, and 20Bk. By the execution of the primary transfer process, the images of the respective colors are transferred in a superimposed manner. Then, a secondary transfer process is performed on the sheet P being a sheet-shaped recording material, thus causing the images to be collectively transferred on the recording material.

Around each of the photoconductive drums 20Y, 20C, 20M, and 20Bk, devices that perform image forming process along with the rotation of each of the photoconductive drums 20Y, 20C, 20M, and 20Bk are arranged. Taking an example of the photoconductive drum 20Bk that forms a black toner image, the following describes an image forming operation to form the black toner image. Around the photoconductive drum 20Bk, a charger 30Bk, a developing device 40Bk, a primary transfer roller 12Bk, and a cleaner 50Bk that perform image formation process are arranged in this order in a rotation direction of the photoconductive drum 20Bk. An optical writing device 8 is used for optical writing using writing light Lb that is performed after uniform charging by the charger 30Bk.

In the superimposed transfer onto the transfer belt 11, the toner images formed on the photoconductive drums 20Y, 20C, 20M, and 20Bk are transferred in a superimposed manner onto the same position of the transfer belt 11 in a process in which the transfer belt 11 moves in the A1 direction in FIG. 5. For this reason, in the primary transfer, primary transfer rollers 12Y, 12C, 12M, and 12Bk facing the photoconductive drums 20Y, 20C, 20M, and 20Bk with the transfer belt 11 apply voltages at different timings shifted from upstream to downstream in the A1 direction in FIG. 5.

The photoconductive drums 20Y, 20C, 20M, and 20Bk are arranged in this order from upstream in the A1 direction in FIG. 5. The photoconductive drums 20Y, 20C, 20M, and 20Bk are provided in image stations that form yellow (Y), cyan (C), magenta (M), and black (Bk) images, respectively.

The image forming apparatus 500 includes four image stations that perform an image forming process for each color, and a transfer belt unit 10 that is disposed above and facing the photoconductive drums 20Y, 20C, 20M, and 20Bk and includes the transfer belt 11 and primary transfer rollers 12Y, 12C, 12M, and 12Bk. The image forming apparatus 500 further includes a secondary transfer roller 5 disposed opposite the transfer belt 11 and driven by the transfer belt 11 to rotate together with the transfer belt 11, and a belt cleaning device 13 disposed opposite the transfer belt 11 to clean the transfer belt 11. The optical writing device 8 is also provided below the 4 image stations.

The optical writing device 8 includes a semiconductor laser as a light source for writing an electrostatic latent image, a coupling lens, an fθ lens, a toroidal lens, a folding mirror, a rotary polygon mirror as a polarizing unit, and the like. The optical writing device 8 is configured to emit writing light Lb corresponding to each color to the photoconductive drums 20Y, 20C, 20M, and 20Bk to form electrostatic latent images on the photoconductive drums 20Y, 20C, 20M, and 20 Bk. In FIG. 5, for the sake of convenience, the writing light Lb is denoted only for the image station of the black image, but the same applies to the other image stations.

The image forming apparatus 500 includes a sheet feeding device 61 as a sheet feeding cassette in which the sheets P to be conveyed toward between the transfer belt 11 and the secondary transfer roller 5 are stacked. The image forming apparatus 500 further includes a registration roller pair 4 to feed the sheet P conveyed from the sheet feeding device 61 toward a secondary transfer portion between the transfer belt 11 and the secondary transfer roller 5 at a predetermined timing matched with the timing of forming the toner image by the image station. A sensor is also provided to detect that a leading edge of the sheet P has reached the registration roller pair 4.

The image forming apparatus 500 further includes the fixing device 100 and ejection rollers 7. The fixing device 100 is a fixing unit of a contact heating type to fix the toner image onto the sheet P onto which the toner image has been transferred. The ejection rollers 7 eject the sheet P onto which the toner image has been fixed to the outside of a body of the image forming apparatus 500. As described in the above embodiment, the fixing device 100 includes the fixing belt 101. In addition, a sheet ejection tray 17 is provided in an upper portion of the body of the image forming apparatus 500. The sheet ejection tray 17 stacks the sheet P ejected to the outside of the body of the image forming apparatus 500 by the ejection rollers 7. Toner bottles 9Y, 9C, 9M, and 9Bk filled with yellow, cyan, magenta, and black toners are provided in the apparatus body below the sheet ejection tray 17.

In addition to the transfer belt 11 and the primary transfer rollers 12Y, 12C, 12M, and 12Bk, the transfer belt unit 10 includes a driving roller 72 and a driven roller 73 around which the transfer belt 11 is looped.

The driven roller 73 also has a function as a tension biasing member for the transfer belt 11, and the driven roller 73 is provided with a biasing member using a spring or the like. For example, the transfer belt unit 10, the primary transfer rollers 12Y, 12C, 12M, and 12Bk, the secondary transfer roller 5, and the belt cleaning device 13 constitute a transfer device 71.

The sheet feeding device 61 is disposed in a lower portion of the body of the image forming apparatus 500, and includes a feeding roller 3 to contact an upper surface of an uppermost sheet P. When the feeding roller 3 is driven to rotate counterclockwise in FIG. 5, the uppermost sheet P is fed toward the registration roller pair 4.

The belt cleaning device 13 provided in the transfer device 71 includes a cleaning brush and a cleaning blade disposed so as to face and contact the transfer belt 11. The belt cleaning device 13 scrapes and removes foreign matter such as residual toner on the transfer belt 11 with the cleaning brush and the cleaning blade, to clean the transfer belt 11. The belt cleaning device 13 further includes a discharging unit to discharge and discard the residual toner removed from the transfer belt 11.

The image forming apparatus 500 of the present embodiment includes the fixing device 100 including the fixing belt 101. Accordingly, the fixing belt 101 has a highly smooth surface and can restrain image unevenness in the fixing portion (fixing device) not only initially but also for a long period of time and provide high image quality.

Although some embodiments of the present disclosure have been described above, embodiments of the present disclosure are not limited to the above-described embodiments. That is, although the present disclosure has been particularly illustrated and described mainly with respect to specific embodiments, various modifications can be made to the above-described embodiments by those skilled in the art in terms of shapes, materials, quantities, and other detailed configurations without departing from the technical idea and the scope of the object of the present disclosure. Therefore, the description with the above-described disclosure of the shape, the material, etc. is exemplarily described for facilitating the understanding of the present disclosure, and is not intended to limit the present disclosure. The description in the name of a member from which some or all of the limitations such as the limitation have been removed is included in the present disclosure.

EXAMPLES

Hereinafter, the present disclosure will be described in more detail with reference to examples and comparative examples. However, the present disclosure is not limited to the following examples.

Production of Fixing Belt

Example 1

First, a fixing belt was produced.

Preparation of Coating Liquid for Fixing Belt

As materials, 4-(2-phenylethynyl) phthalic anhydride (PEPA) manufactured by Manac Co., Ltd., 3,3',4,4'-benzophenonetetracarboxylic dianhydride (BTDA) manufactured by Daicel Chemical Industries, Ltd., and 3,4'-diaminodiphenyl ether (3,4'-DDE) manufactured by Wakayama Seika Kogyo Co., Ltd. were mixed in a molar ratio of 0.5:0.5:1.0, and propylene carbonate was used as solvent. The solubility parameter (SP value) of propylene carbonate is 27.2 $(J/cm^3)^{1/2}$. The above materials were polymerized at 130° C. in a nitrogen atmosphere to prepare a polyimide precursor solution having a solid content of 15% and a viscosity of 10 Pa·s (25° C.). Subsequently, a dispersion liquid of carbon black (Regal400R, manufactured by Cabot Corporation) dispersed in the above-mentioned solvent (propylene carbonate) was prepared so that the carbon black content was 18% by weight of the polyamic acid solid content, and sufficiently stirred and mixed to prepare a coating liquid for the fixing belt.

Production of Fixing Belt

A metal cylinder having an outer diameter of 147 mm and a length (width) of 340 mm and having an outer surface roughened by blasting was used as a mold for the fixing belt. While the cylindrical mold was rotated at 50 rpm, the coating solution was uniformly cast on the outer surface of the cylindrical mold using a dispenser. At the time when a predetermined total amount of the coating solution was completely flowed and the coating film was uniformly spread, the mold was placed in a dryer while the number of revolutions was increased to 100 rpm, and then a halogen heater was installed at the center of the inside of the mold to gradually increase the temperature to 110° C., followed by heating for 60 minutes. Thereafter, the temperature was further raised and heated at 200° C. for 20 minutes, and subsequently, the temperature was raised stepwise to 320° C. and heated (fired) for 60 minutes to perform imide conversion, and after slow cooling, demolding was performed. Thus, an endless fixing belt was obtained.

Examples 2 to 6, Comparative Examples 1 to 3

As Examples 2 to 6 and Comparative Examples 1 to 3, fixing belts were produced in the same manner as in Example 1 except that the propylene carbonate used as the solvent in Example 1 was variously changed and the solvent content in the polyimide layer was variously changed by changing the heating time at 200° C. as described below, and the fixing belts were evaluated. The heating time at 200° C. was 20 minutes in Example 1, 15 minutes in Example 2, 20 minutes in Example 3, 20 minutes in Example 4, five minutes in Example 5, 20 minutes in Example 6, 400 minutes in Comparative Example 1, five minutes in Comparative Example 2, and five minutes in Comparative Example 3. In Comparative Example 1, the content of N-methyl-2-pyrrolidone in the polyimide layer was set to 0 ppm by using N-methyl-2-pyrrolidone as the solvent of the coating liquid for a fixing belt and setting the heating time at 200° C. to 400 minutes. Table 1 represents the physical properties (boiling point, solubility parameter (SP value, $(J/cm^3)^{1/2}$), and whether or not the solvent is aprotic) of the solvents used in Examples 1 to 6 and Comparative Examples 1 to 3.

TABLE 1

Physical properties of solvents

| | Types of Solvent | Boiling Point (° C.) | SP Value $(J/cm^3)^{1/2}$ | Protic/ Aprotic |
|---|---|---|---|---|
| Embodiment 1 | Propylene carbonate | 240 | 27.2 | Aprotic |
| Embodiment 2 | Propylene carbonate | 240 | 27.2 | Aprotic |
| Embodiment 3 | Ethylene carbonate | 244 | 30.1 | Aprotic |
| Embodiment 4 | Butylene carbonate | 251 | 24.8 | Aprotic |
| Embodiment 5 | Formyl morpholine | 238 | 26.6 | Aprotic |
| Embodiment 6 | Sulfolane | 285 | 27.4 | Aprotic |
| Comparative Example 1 | None | — | — | — |
| Comparative Example 2 | N-Methyl-2-Pyrrolidone | 202 | 22.9 | Aprotic |
| Comparative Example 3 | 1,3-Dimethyl-2-imidazolidinone | 225 | 23.3 | Aprotic |

Evaluation of Fixing Belt

Next, the average thickness of the fixing belts produced in Examples 1 to 6 and Comparative Examples 1 to 3 (that is, the average thickness of the polyimide layer in Examples 1 to 6 and Comparative Examples 1 to 3) and the content of the solvent were measured. The smoothness of the surface of the fixing belt was evaluated. The fixing belt was used in an image forming apparatus to evaluate image quality.

The average thickness of the fixing belt was calculated by the following method. First, on the center line in the width direction of the fixing belt, the thickness was measured at 10 points at intervals of 45 mm in the circumferential direction. The thickness was measured using an electric micrometer manufactured by Anritsu Corporation. Next, the average value of the measured values at the 10 points was calculated and defined as the average thickness of the fixing belt.

The content of the solvent was measured by a thermal extraction gas chromatography/mass spectrometry (GC/MS) method. As a GC-MS apparatus, GCMS QP 2010 manufactured by Shimadzu Corporation was used. As data analysis software, GCMS solution manufactured by Shimadzu Corporation was used. As a heat extraction apparatus, Py2020D manufactured by Frontier Laboratories Ltd. was used. Detailed conditions of the thermal extraction GC/MS method are as follows.

1. Heat extraction conditions: extraction temperature× time; 370° C.×15 minutes, cryotrap; −190° C. (N2Liq), sample amount; 0.4 mg to 1.0 mg,
2. Column: Ultra ALLOY-5 L=30 m, ID=0.25 mm, Film=0.25 μm,
3. Column temperature rise: from 60° C. to 300° C. at 30° C./min,
4. Column flow rate: 1.0 ml/min,
5. Ionization method: Electro ionization (EI) method (70 eV)
6. Injection mode: Split (1:50)
7. Measurement mode: selected ion detection (selected ion monitoring (SIM) method)

In addition, a solvent such as propylene carbonate used in the production of the fixing belt was diluted with an acetone solvent, and measurement was performed under the same conditions (370° C.×15 minutes extraction) to prepare a calibration curve.

The smoothness was evaluated by the arithmetic mean waviness (Wa) of the surface of the fixing belt. The arithmetic average waviness (Wa) was measured using a surface roughness measuring device SURFCOM 1400G (manufactured by Tokyo Seimitsu Co., Ltd.). When the arithmetic mean waviness (Wa) is equal to or smaller than 0.020, the smoothness of the fixing belt surface was evaluated as high.

The image quality was evaluated as follows. The produced fixing belt was used as a fixing belt of an electrophotographic image forming apparatus (imagio Color 5100, manufactured by Ricoh Company, Ltd.), and output images were visually evaluated. The evaluation was performed initially and after 10 million sheets ($10000\times10^3$ sheets) were passed. The sheet passing was performed by outputting a solid image having an area of 250 mm×150 mm on A4 size PPC plain paper "My Paper" (manufactured by Ricoh Company, Ltd.) as a recording material. As the evaluation criteria, a case where density unevenness and white spots were not visually recognized on the output image was evaluated as "good", and a case where density unevenness and white spots were visually recognized even slightly on the output image was evaluated as "poor".

Table 2 represents the evaluation results of the average thickness, the content of the solvent, the arithmetic average waviness (Wa) of the surface of the fixing belt, and the image unevenness.

TABLE 2

Evaluation results of fixing belt

| | Solvent | | Evaluation Results of Fixing Belt | | | |
|---|---|---|---|---|---|---|
| | | | | Arithmetic | Image Quality | |
| | Type of Solvent | Content of Solvent (ppm) | Average Thickness (μm) | Average Waviness (Wa) (μm) | Initial Stage | After 10 million Prints |
| Embodiment 1 | Propylene carbonate | 0.8 | 85 | 0.010 | Good | Good |
| Embodiment 2 | Propylene carbonate | 976 | 102 | 0.010 | Good | Good |
| Embodiment 3 | Ethylene carbonate | 9.8 | 120 | 0.006 | Good | Good |
| Embodiment 4 | Butylene carbonate | 20.4 | 98 | 0.012 | Good | Good |
| Embodiment 5 | Formyl morpholine | 106 | 80 | 0.008 | Good | Good |
| Embodiment 6 | Sulfolane | 223 | 64 | 0.009 | Good | Good |
| Comparative Example 1 | None | 0 | 86 | 0.540 | Poor | Poor |
| Comparative Example 2 | N-Methyl-2-Pyrrolidone | 44.4 | 101 | 0.890 | Poor | Poor |
| Comparative Example 3 | 1,3-Dimethyl-2-imidazolidinone | 54.8 | 108 | 1.380 | Poor | Poor |

[Evaluation Results]

In the fixing belts of Examples 1 to 6, the content of the solvent was not lower than 0.1 and not higher than 1000 ppm, and the average thickness was not less than 60 μm and not greater than 140 μm. In Examples 1 to 6, the arithmetic average waviness (Wa) of the fixing belt was 0.006 to 0.012, and all the result data were not greater than 0.020, indicating that the smoothness of the fixing belt surface was high. On the other hand, the arithmetic average waviness (Wa) of the fixing belts of Comparative Examples 1 to 3 was 0.540 to 1.380, and all the results were larger than 0.020, indicating that the smoothness of the fixing belt surface was not high. In addition, in the evaluation of the image quality, when the fixing belts of Examples 1 to 6 were used, density unevenness and white spots were not visually recognized on the output image at the initial stage and after 10 million sheets were passed, and it was proved that high image quality was maintained not only at the initial stage but also over a long period of time. On the other hand, in Comparative Examples 1 to 3, density unevenness and white spots were visually recognized on the output image both at the initial stage and after passing 10 million sheets.

From the above evaluation results, it was indicated that by using the fixing belts of Examples 1 to 6, which are exemplary embodiments of the present disclosure, image unevenness in the fixing portion can be restrained for a long period of time.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A fixing belt comprising a polyimide layer, the polyimide layer comprising:

polyimide; and an aprotic solvent having a boiling point not lower than 230° C. and a solubility parameter not less than 24.5 $(J/cm^3)^{1/2}$ and not greater than 30.7 $(J/cm^3)^{1/2}$, the solvent having a content not less than 0.1 ppm and not greater than 1000 ppm in the polyimide layer.

2. The fixing belt according to claim 1, wherein the solvent comprises any one or a combination of two or more selected from a group consisting of propylene carbonate, butylene carbonate, ethylene carbonate, formyl morpholine, diethyl sulfone, ethyl methyl sulfone, methyl propyl sulfone, ethyl isopropyl sulfone, 3-methyl sulfolane, 2,4-dimethyl sulfolane, and sulfolane.

3. The fixing belt according to claim 1, wherein an average thickness of the polyimide layer is not smaller than 60 μm and not greater than 140 μm.

4. The fixing belt according to claim 1, wherein the polyimide layer further comprises conductive particles.

5. The fixing belt according to claim 4, wherein the conductive particles are any one or a combination of two or more selected from a group consisting of a metal oxide, a carbon black, an ion conductive material, and a conductive polymer material.

6. The fixing belt according to claim 5, wherein the metal oxide is any one or a combination of two or more selected from a group consisting of zinc oxide, tin oxide, titanium oxide, zirconium oxide, aluminum oxide and silicon oxide.

7. The fixing belt according to claim 5, wherein the carbon black is any one or a combination of two or more selected from a group consisting of ketjen black, furnace black, acetylene black, thermal black and gas black.

8. The fixing belt according to claim 5, wherein the ion conductive material is any one or a combination of two or more selected from a group consisting of tetraalkylammonium salt, trialkyl benzyl ammonium salt, alkyl sulfonic acid, alkylbenzene sulfonate, alkyl sulfate, glycerin fatty acid ester, sorbitan fatty acid ester, polyoxyethylene alkylamine, polyoxyethylene fatty alcohol ester, alkyl betaine, and lithium perchlorate.

9. The fixing belt according to claim 5, wherein the conductive polymer material is polyaniline.

10. A fixing device comprising: the fixing belt according to claim 1;

a nip forming member inside an inner circumferential surface of the fixing belt; and a pressing member opposite the nip forming member to press a recording material toward the fixing belt.

11. An image forming apparatus comprising the fixing device according to claim 10.

* * * * *